United States Patent [19]

Harris

[11] Patent Number: 4,711,384

[45] Date of Patent: Dec. 8, 1987

[54] TAPE DISPENSING DEVICE

[76] Inventor: Rod W. Harris, 1011 Arlington Blvd. #907, Arlington, Va. 22209

[21] Appl. No.: 8,046

[22] Filed: Jan. 21, 1987

Related U.S. Application Data

[63] Continuation of Ser. No. 675,328, Nov. 27, 1984, abandoned.

[51] Int. Cl.[4] ..... B65D 85/672

[52] U.S. Cl. ..... 225/66; 225/82; 225/91

[58] Field of Search ..... 225/65, 66, 56, 58, 225/82, 91

[56] References Cited

U.S. PATENT DOCUMENTS

| | | | |
|---|---|---|---|
| D. 150,498 | 8/1948 | Hazelton . | |
| D. 170,456 | 9/1953 | Gershen . | |
| D. 182,862 | 5/1958 | Wax . | |
| 2,262,260 | 11/1941 | Smith | 30/126 |
| 2,284,807 | 6/1942 | Donahoo | 206/52 |
| 2,472,761 | 6/1949 | Reed | 164/84.5 |
| 2,572,245 | 10/1951 | Coldiron | 225/56 X |
| 2,609,877 | 9/1952 | Hannington | 164/84.5 |
| 2,676,658 | 4/1954 | King | 225/65 X |
| 2,677,425 | 5/1954 | Broyles | 164/84.5 |
| 2,717,641 | 9/1955 | Wiederspan | 164/84.5 |
| 2,734,575 | 2/1956 | Gilbreth | 164/84.5 |
| 2,734,576 | 2/1956 | Slezak . | |
| 3,378,184 | 4/1968 | Mallory | 225/66 |
| 3,410,464 | 11/1968 | Costello | 225/65 |
| 3,684,141 | 8/1972 | Hall | 225/65 |
| 3,684,626 | 8/1972 | Wood | 156/576 |
| 3,904,095 | 9/1975 | Doyle | 225/56 |
| 3,970,230 | 7/1976 | Horn | 225/65 |
| 4,405,068 | 9/1983 | Blair | 225/65 |

FOREIGN PATENT DOCUMENTS

| | | |
|---|---|---|
| 156426 | 5/1954 | Australia . |
| 243502 | 2/1963 | Australia . |
| 498366 | 1/1951 | Belgium . |
| 1066913 | 10/1959 | Fed. Rep. of Germany . |
| 1224656 | 6/1960 | France . |
| 533746 | 9/1955 | Italy . |
| 270395 | 8/1950 | Switzerland . |
| 915691 | 1/1963 | United Kingdom . |
| 2095154 | 9/1982 | United Kingdom . |

*Primary Examiner*—Frank T. Yost

*Attorney, Agent, or Firm*—Banner, Birch, McKie & Beckett

[57] ABSTRACT

An ergonomically shaped tape dispensing and cutting device adapted to snap over a roll of masking tape or the like and be retained on the roll, affording a convenient tearing edge for severing the tape. The device is preferably a one-piece molded plastic article comprising a top wall which rides over the outer periphery of the tape roll and two flexible side walls which depend from the top section and flank opposite sides of the roll of tape when the invention is positioned on a roll of tape. A cutting blade may be fixed to or integrally formed with the dispenser. Inwardly projecting shoulders are fixed to the front bottom surface of the side walls in opposing spaced relation and serve to spread the side walls apart as the tape dispenser and cutter is pressed down over a roll of tape. As the shoulders clear the inner core of the tape roll, the shoulders are snapped back beneath the core of the roll and serve to retain the invention on the roll of tape. The top wall includes a thumb-receiving control recess to enhance control and stability. The side walls taper downwardly along an arc of a circle so that the device fits comfortably and securely in the apex of thumb and forefinger.

13 Claims, 4 Drawing Figures

FIG. 1
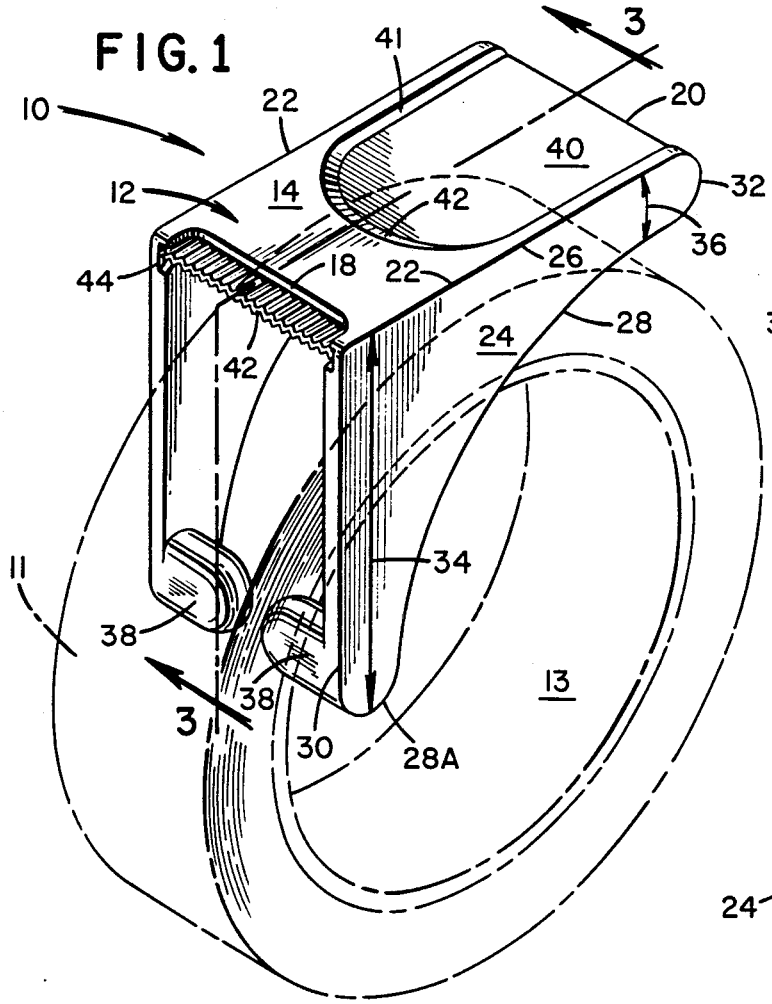
FIG. 4
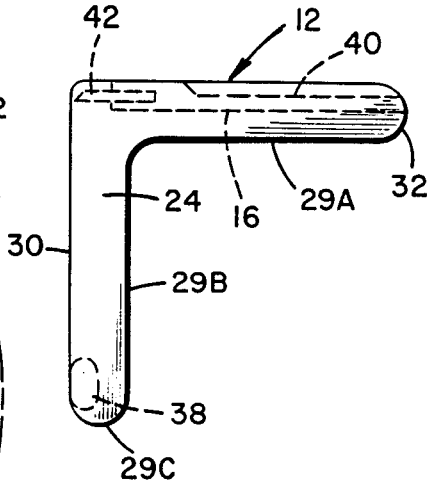
FIG. 2
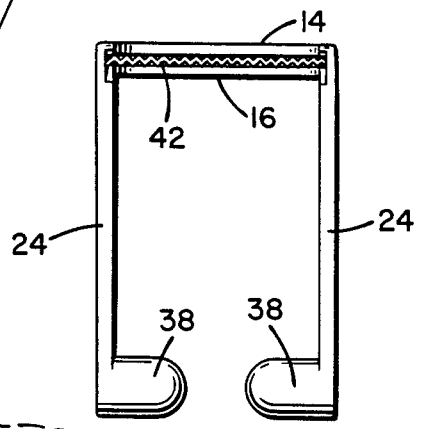
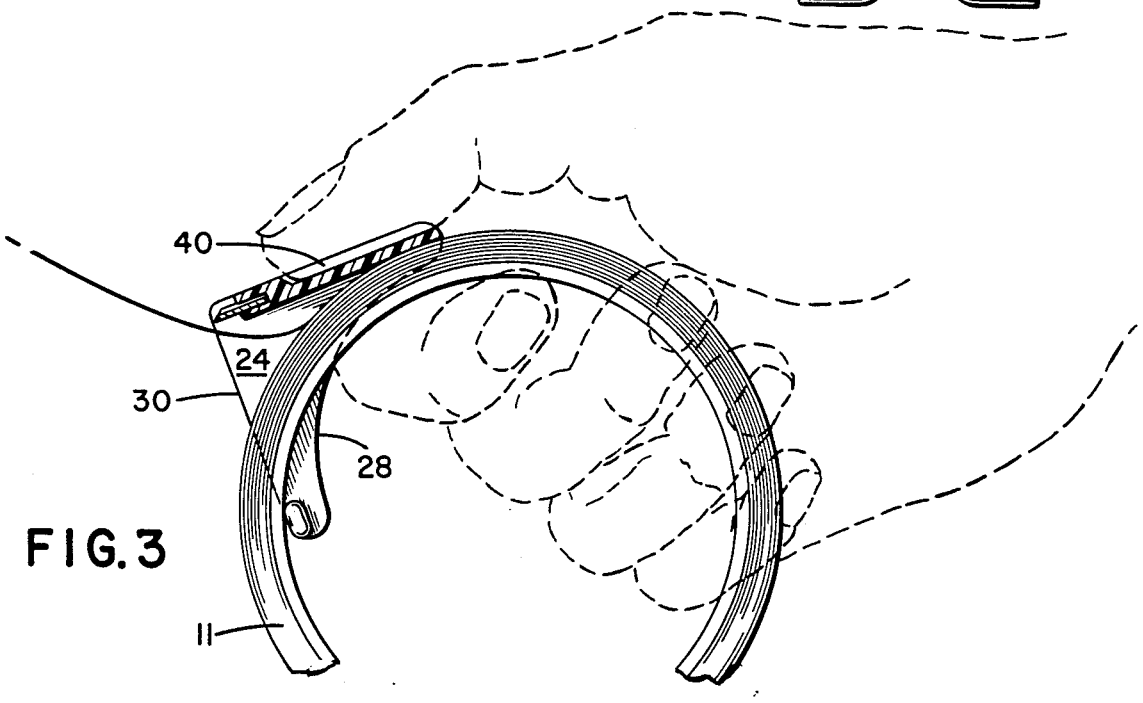
FIG. 3

TAPE DISPENSING DEVICE

This application is a continuation Ser. No. 675,328, filed Nov. 27, 1984, now abandoned.

BACKGROUND OF THE INVENTION

This invention relates to a device for severing a desired, variable amount of tape from a roll of tape. More particularly, the invention relates to a portable, reusable tape cutting and dispensing device.

The prior art is repleat with various tape dispensing and tape cutting inventions. The term "tape dispenser" is used in the art to refer to devices which both "cut" and "dispense" tape and will be so used in this application. The number of patents in this relatively simple technological field is indicative of the need for a simple, yet highly effective and safe tape dispensing device which may be re-used on a number of rolls of tape.

Prior art tape dispensers include one-piece, hand-held tape cutters which are designed to be snapped over, or simply seated on, a roll of tape. One such device is disclosed in Horn, U.S. Pat. No. 3,970,230. The Horn device, however, relies on downward pressure from a single point of contact, the thumb, as the only means for the user to hold, control, and stabilize the device. Other prior art devices include tape cutters with deformable legs which must be bent beneath the core of the tape roll to retain the cutter in position. Such deformable legs break frequently. These and other tape dispensing and cutting devices include separate parts or members which must be manually positioned beneath the core of the tape roll to retain it in position on the roll. Still other prior art devices include complex structures involving articulated or spring biased members which engage the interior of the core of the tape roll. Not one of the prior known tape cutting and dispensing devices, however, provides a simple, ergonomically formed device which provides the user with exceptional stability and control to effect safe and accurate cutting.

SUMMARY OF THE INVENTION

The tape dispensing and cutting device of the present invention is adapted to snap over a roll of masking tape or the like and be retained on the roll, affording a convenient tearing edge for severing the tape. Except for a cutting blade which is retained in a slot in the device, the device is preferably an egonomically formed one-piece molded plastic article comprising a top wall which rides over the periphery of the tape roll and two flexible side walls which depend from the top section and flank opposite sides of the roll of tape when the invention is positioned on a roll of tape. Inwardly projecting shoulders are fixed to the front bottom surface of the side walls in opposing spaced relation and serve to spread the side walls apart as the tape dispenser is pressed down over a roll of tape. As the shoulders clear the inner core of the tape roll, the shoulders are snapped back beneath the core of the roll and serve to retain the invention on the roll of tape.

The top surface of the top wall is preferably provided with an ergonomically formed control recess which allows for exceptional control and lateral stability of the invention, and facilitates forward and backward movement of the tape dispenser on the roll of tape.

In a preferred form, the bottom edge of the side wall tapers downwardly from back to front along an arc of a circle so that the downward extension of the side wall from the top wall is greater at the front edge of the side wall than at the back edge. This provides an ergonomic shape which allows the forefinger to grasp the tape and core directly beneath the thumb, while the other fingers curl under the tape core in a complete and natural grip. Thus, the device is fully supported at the apex between thumb and forefinger, which allows for the complete control of the tape and the dispenser, no matter how little tape remains on the roll. The curved taper of the side wall also ensures that the downward extent of the side wall is sufficient to laterally stabilize the cutter as tape is used and the radial thickness of the tape roll decreases.

BRIEF DESCRIPTION OF THE DRAWING

FIG. 1 is a perspective view of a tape dispensing device according to the invention positioned on a roll of tape, shown in phantom outline.

FIG. 2 is a front plan view of a tape dispenser according to the present invention.

FIG. 3 is a side plan view of the tape dispenser of the present invention positioned on a roll of tape, with the hand of a user shown in dotted outline.

FIG. 4 is a side plan view of an alternative configuration of the tape dispenser of the present invention.

DETAILED DESCRIPTION

The tape dispenser of the present invention is shown generally in FIG. 1 at 10 positioned on a roll of tape 11 having a core 13. Tape dispenser 10 includes a top wall 12 having a top surface 14, and a bottom surface 16. Top wall 12 also has a front edge 18, a back edge 20 and side edges 22. The width of top wall 12 is slightly greater than the width of the tape roll on which it is used. The length of top wall 12 and the relationship and size of all elements are humanly engineered in direct proportion to the natural grip of a person's hand and to fit the various generally available sized tape rolls.

Flexible side walls 24 are perpendicular to and extend downwardly from each of the side edges 22 of top wall 12. Side walls 24 each have a top edge 26, a bottom edge 28, a front edge 30 and a back edge 32. Top edge 26 of side walls 24 abuts and is coextensive with side edges 22 of top wall 12, so that at the intersection of the side wall and top wall, the side wall extends the entire length of the top wall as shown in FIG. 1.

Bottom edge 28 of side walls 24 is tapered or otherwise ergonomically shaped to allow the user to comfortably and conveniently grip and control dispenser 10. In a preferred embodiment, the taper is downward from back edge 32 towards front edge 30 along an arc of a circle to thus define a smooth tapering surface, although other ergonomically shaped tapering or cutaway configurations which allow the tape dispenser to fit securely and comfortably in the apex between thumb and forefinger may also be used.

One alternative configuration is shown in FIG. 4, where side wall 24 has a generally L-shaped configuration. In this configuration, bottom edge 28 is "tapered" or cutaway by having a first edge 29A which extends from back edge 32 towards, but terminating inwardly from, front edge 30 of side wall 24. Bottom edge 29A is parallel to but spaced downwardly from top wall 12. Bottom edge 29B extends from the inner terminal end of edge 29A and is perpendicular to edge 29A. Bottom edge portion 29C connects bottom edge 29B to front edge 30. Thus, in the configuration shown in FIG. 4, a "tapered" or ergonomic cutaway portion is formed.

The tapered bottom edge 28 in FIGS. 1-3, or bottom edge 29A-C in FIG. 4 also allows the downward extension of side walls 24 from top wall 12 to be greater at its front edge, as shown at 34, than at the back edge of side wall 24, as shown at 36. Although in a preferred form of the invention, bottom edge 28 tapers from near top edge 26 to near front edge 30, and thus includes connecting portion 28A which connects bottom edge 28 to front edge 30, it is within the scope of the invention to have the downwardly tapering bottom edge 28 extend from top edge 26 to front edge 30, while maintaining the ergonomically shaped form of the dispenser. The downward extent 34 of front edge 30 is sufficient to span the full thickness of a tape roll on which it is to be used.

Tape dispenser 10 includes shoulders 38 perpendicular to and projecting inwardly from the inner surface of side walls 24. Shoulders 38 are positioned near the intersection of the bottom edge and front edge of side walls 24 in opposing spaced relation. Sidewalls 24 are spaced a distance sufficient to allow sidewalls 24 to flank opposite sides of roll 11. The distance may, of course, vary to accommodate tape rolls of different size. Shoulders 38 serve to spread sidewalls 24 as dispenser 10 is placed on a roll of tape 11. After shoulders 38 clear the inner radial edge of roll 11, they snap back underneath the core and help to retain dispenser 10 on tape roll 11.

Top surface 14 of top wall 12 has a control recess 40 adjacent to back edge 20 of top wall 12. Control recess 40 has sidewalls 41. In a preferred form, the control recess 40 extends approximately one-sixteenth (1/16) of an inch below top surface 14 and includes a curved front edge 42 to generally conform to the shape of the thumb.

A cutting edge is provided for severing tape. Preferably, the cutting edge is a blade 42 retained within a groove 44 on the inner surface of side walls 24. As shown in FIGS. 1 and 3, cutting blade 42 is parallel to and substantially coextensive with top surface 14 of top wall 12. Although a serrated edge blade is shown and is the preferred blade for generally cutting tape, a spike, pointed, or a pyramid-shaped blade may be preferred for cutting certain types of tape, such as vinyl tape.

Preferably, dispenser 10 is molded in one piece from plastic or similar materials. However, light gauge metals or the like may also be used. Also, blade 42 may be integrally formed as part of dispenser 10 rather than a separate piece inserted in groove 44, as shown.

In use, dispenser 10 is snapped onto a roll 11 and may be freely placed at any position on the roll. Dispenser 10 is readily guided about roll 11 by a user's thumb in control recess 40. Sidewall 41 allows the thumb to laterally stabilize dispenser 10. When dispenser 10 has been positioned to cut a desired length of tape, dispenser 10 and roll 11 may both be grasped firmly in the apex of thumb and forefinger to provide a large surface area of support for dispenser 10 which provides stability and control while severing the tape. Additionally, control recess 40 allows the user's thumb to not only provide downward pressure in opposition to the fingers, but to also provide lateral support and stability during tape tearing. Shoulders 38 abut the inner surface of core 13 and serve to further stabilize dispenser 10 on roll 11. Recess 40 also allows the user to adjust the position of dispenser 10 on the tape roll to cut precisely the desired amount of tape. After roll 11 is depleted, dispenser 10 is readily removed by spreading sidewalls 24 and may be reused.

Although a particular preferred embodiment has been described, it is not intended to limit the invention thereto. Various modifications and changes will occur to those of ordinary skill in the art, and the invention is defined only by the following claims.

I claim:

1. A dispensing device adapted to be mounted on a core mounted roll of flexible material to facilitate manual engagement of the roll and dispensing and severing of a length of said material comprising:

a top wall having a top surface, a bottom surface, a front edge, a back edge and side edges, said front edge of said top wall having cutting means for cutting a desired length of material to be dispensed, said top surface of said top wall having a user-engageable portion;

a side wall perpendicular to and extending downwardly from each of said side edges of said top wall, said side walls having a top edge, a bottom edge, a front edge, and a back edge, said bottom edge of said side walls curving ergonomically downwardly along a continuous concave arc from said back edge of said sidewall toward said front edge of said sidewall so that the downward extension of said side walls from said top wall is greater at said front edge of said side wall than at said back edge of said side wall thereby defining a downwardly curving continuous concave user-engageable bottom edge, said downwardly curving continuous concave arc allowing continuous opposing manual engagement of said user-engageable portion of said top surface of said top wall, said user-engageable portion of said downwardly curving continuous concave bottom edge of said side wall, and core when the dispensing device is mounted on a core mounted roll of flexible material; and a shoulder perpendicular to and projecting inwardly from at least one of said side walls towards the other of said side walls, said shoulder terminating at a point spaced from said other side wall, said shoulder adapted to position and retain said device on said roll.

2. A dispensing device as recited in claim 1 further comprising a second shoulder perpendicular and projecting inwardly from said other of said side walls, said second shoulder terminating at a point spaced from said one side wall.

3. A dispensing device as recited in claim 2 wherein said shoulders are positioned near the intersection of said bottom edge and said front edge of said side walls in opposing spaced relation.

4. A dispensing device as recited in claim 1 wherein said user-engageable portion on said top surface of said top wall comprises a control recess to facilitate holding and using the dispensing device.

5. A dispensing device as recited in claim 1 wherein said cutting means comprises a cutting blade.

6. A dispensing device as recited in claim 5 wherein said cutting blade is parallel to said top surface of said top wall.

7. A dispensing device as recited in claim 5 wherein said top wall, said cutting blade, said side walls, and said shoulder are integrally formed in one piece.

8. A dispensing device as recited in claim 1 wherein said top wall, said side walls, and said shoulder are integrally formed in one piece.

9. A hand-held tape dispensing and severing device adapted to be positioned on a core mounted multi-layered roll of tape having an inner periphery and an outer periphery, and adapted to facilitate manual engagement of the roll of tape, said tape dispensing and severing device comprising:

a top wall having a top surface, said top surface of said top wall having a user-engageable portion adapted to be engaged by a user's thumb, said top wall further having a bottom surface, a front edge, a back edge and side edges, said front edge of said top wall having cutting means for cutting a desired length of tape from a multi-layered roll of tape;

a side wall perpendicular to and extending downwardly from each of said side edges of said top wall, said side walls having a top edge, a bottom edge, a front edge, a back edge, said bottom edge of said side walls curving ergonomically downwardly along a continuous concave arc from said back edge of said side wall towards said front edge of said side wall so that the downward extension of said side walls from said top wall is greater at said front edge of said side wall than at said back edge of said side wall thereby defining a continuous user-engageable portion of said downwardly curving continuous concave bottom edge, when the tape dispensing and severing device is mounted on a roll of tape, said downwardly curving continuous concave arc allowing continuous manual engagement of said user-engageable portion of said bottom edge of said side wall and the inner periphery of a roll of tape in opposition to the user's thumb on said user-engageable portion of said top surface; and a shoulder perpendicular to and projecting inwardly from each of said side walls in opposing spaced relation, said shoulders adapted to abut the inner periphery of a roll of tape on which said dispensing device is used in order to retain said device of said roll.

10. A dispensing device as recited in claim 9 wherein said user-engageable portion on said top surface of said top wall comprises a control recess.

11. A dispensing device as recited in claim 9 wherein said top wall, said side walls, and said shoulders are integrally formed in one piece.

12. A dispensing device as recited in claim 11 wherein said cutting means comprises a cutting blade fixed within a groove in said side walls and top wall.

13. A dispensing device as recited in claim 12 wherein said cutting blade is parallel to said top surface of said top wall.

* * * * *